US010458190B2

(12) United States Patent
Zhang

(10) Patent No.: US 10,458,190 B2
(45) Date of Patent: Oct. 29, 2019

(54) PDC CUTTER WITH DEPRESSED FEATURE

(71) Applicant: Smith International, Inc., Houston, TX (US)

(72) Inventor: Youhe Zhang, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 239 days.

(21) Appl. No.: 15/473,666

(22) Filed: Mar. 30, 2017

(65) Prior Publication Data

US 2017/0284161 A1 Oct. 5, 2017

Related U.S. Application Data

(60) Provisional application No. 62/316,551, filed on Mar. 31, 2016.

(51) Int. Cl.

| | |
|---|---|
| ***E21B 10/567*** | (2006.01) |
| ***E21B 10/54*** | (2006.01) |
| ***E21B 10/573*** | (2006.01) |
| ***E21B 10/633*** | (2006.01) |

(52) U.S. Cl.

CPC ..... *E21B 10/5673* (2013.01); *E21B 10/54* (2013.01); *E21B 10/5735* (2013.01); *E21B 10/633* (2013.01)

(58) Field of Classification Search

CPC .... E21B 10/5673; E21B 10/567; E21B 10/54; E21B 10/5735

See application file for complete search history.

(56) References Cited

U.S. PATENT DOCUMENTS

| | | | | |
|---|---|---|---|---|
| 7,703,559 | B2 | 4/2010 | Shen et al. | |
| 8,413,746 | B2 | 4/2013 | Shen et al. | |
| 8,727,043 | B2 | 5/2014 | Zhang et al. | |
| 8,746,367 | B2 * | 6/2014 | DiGiovanni ..... | E21B 10/08 175/50 |
| 8,800,691 | B2 | 8/2014 | Shen et al. | |
| 8,991,523 | B2 | 3/2015 | Shen et al. | |
| 9,033,070 | B2 | 5/2015 | Shen et al. | |
| 9,091,132 | B1 | 7/2015 | Cooley et al. | |
| 9,187,962 | B2 | 11/2015 | Burhan et al. | |
| 9,322,219 | B2 | 4/2016 | Burhan et al. | |
| 9,464,486 | B2 | 11/2016 | Zhang et al. | |
| 9,482,058 | B2 | 11/2016 | Siracki | |
| 2014/0326515 | A1 | 11/2014 | Shi et al. | |
| 2014/0326516 | A1 | 11/2014 | Haugvaldstad et al. | |
| 2014/0374169 | A1 | 12/2014 | Cariveau et al. | |

* cited by examiner

*Primary Examiner* — Catherine Loikith

(57) ABSTRACT

A cutting element includes a table coupled to a substrate at an interface. The table includes a working surface opposite the interface and defined by a perimeter, a table thickness measured between the interface and the working surface, and a torque transmittable depression formed in the working surface of the table a distance away from the perimeter. The torque transmittable depression extends a depth into the table and has a cross-sectional profile with a torque transmittable shape. The depth of the depression may be greater than the thickness of the table, or an optional sensor may be placed in the depression.

20 Claims, 13 Drawing Sheets

PDC CUTTER WITH DEPRESSED FEATURE

This application claims the benefit of, and priority to, U.S. Patent Application No. 62/316,551, filed on Mar. 31, 2016 and titled "PDC Cutter with Depressed Feature(s) on Diamond Table," which application is incorporated herein by this reference in its entirety.

BACKGROUND

Polycrystalline diamond compact ("PDC") cutters have been used in industrial applications including rock drilling and metal machining for many years. In such applications, a compact of polycrystalline diamond (PCD) is bonded to a substrate material such as a sintered metal-carbide to form a cutting structure. PCD includes a polycrystalline mass of diamonds (often synthetic) that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A PDC cutter may be formed by placing a cemented carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn bonded to the substrate. The substrate often includes a metal-carbide composite material, such as tungsten carbide. The deposited diamond layer is often referred to as the "diamond table" or "abrasive layer."

An example of a rock bit for earth formation drilling using PDC cutters is shown in FIG. 1. FIG. 1 shows a rotary drill bit 10 having a bit body 12. The lower face of the bit body 12 is formed with a plurality of blades 14, which extend generally outwardly away from a central longitudinal axis of rotation 16 of the drill bit. A plurality of PDC cutters 18 are positioned side by side along the length of each blade. The number of PDC cutters 18 carried by each blade may vary. The PDC cutters 18 may individually include a polycrystalline diamond table attached to a substrate, which may be formed from tungsten carbide, and are received and secured within sockets in the respective blade.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to cutting elements that have a table coupled to a substrate at an interface, where the table includes a working surface opposite the interface and defined by a perimeter, a table thickness measured between the interface and the working surface, and a torque transmittable depression formed in the working surface of the table a distance away from the perimeter, the torque transmittable depression extending a depth into the table and having a cross-sectional profile with a torque transmittable shape.

In another aspect, embodiments of the present disclosure relate to a cutting element that includes a table coupled to a substrate at an interface. The table includes a working surface opposite the interface and defined by a perimeter. A depression is formed in the working surface of the table, and a sensor is in the torque transmittable depression.

In yet another aspect, embodiments of the present disclosure relate to cutting elements that include a substrate and a table coupled to the substrate at an interface. The table has a table thickness measured between the interface and a working surface opposite the interface and which is defined by a perimeter. The working surface includes a first material forming the perimeter of the working surface, and an interior portion formed of a second material that has higher machinability than the first material, and which is interior to the perimeter.

In another aspect, embodiments of the present disclosure relate to a bit that includes a bit body, at least one cutter pocket formed in the bit body, and at least one cutting element in the at least one cutter pocket. The at least one cutting element includes a substrate and a table coupled to the substrate at an interface. The table has a working surface opposite the interface and is defined by a perimeter. A torque transmittable depression is located in the table and has a cross-sectional profile with a torque transmittable shape. The torque transmittable depression extends from the working surface and has a depth greater than a thickness of the table as measured between the interface and the working surface, such that the depression extends through the interface and into the substrate.

In yet another aspect that may be combined with any one or more other aspects disclosed herein, at least two spaced apart depressions are formed in a working surface. Each of the depressions may extend a depth into the diamond table, and a circumferential cutting edge may extend an arc length around a perimeter of the working surface.

Other aspects and features of the present disclosure will be apparent from the following description and the appended claims.

DETAILED DESCRIPTION

Figure 1:
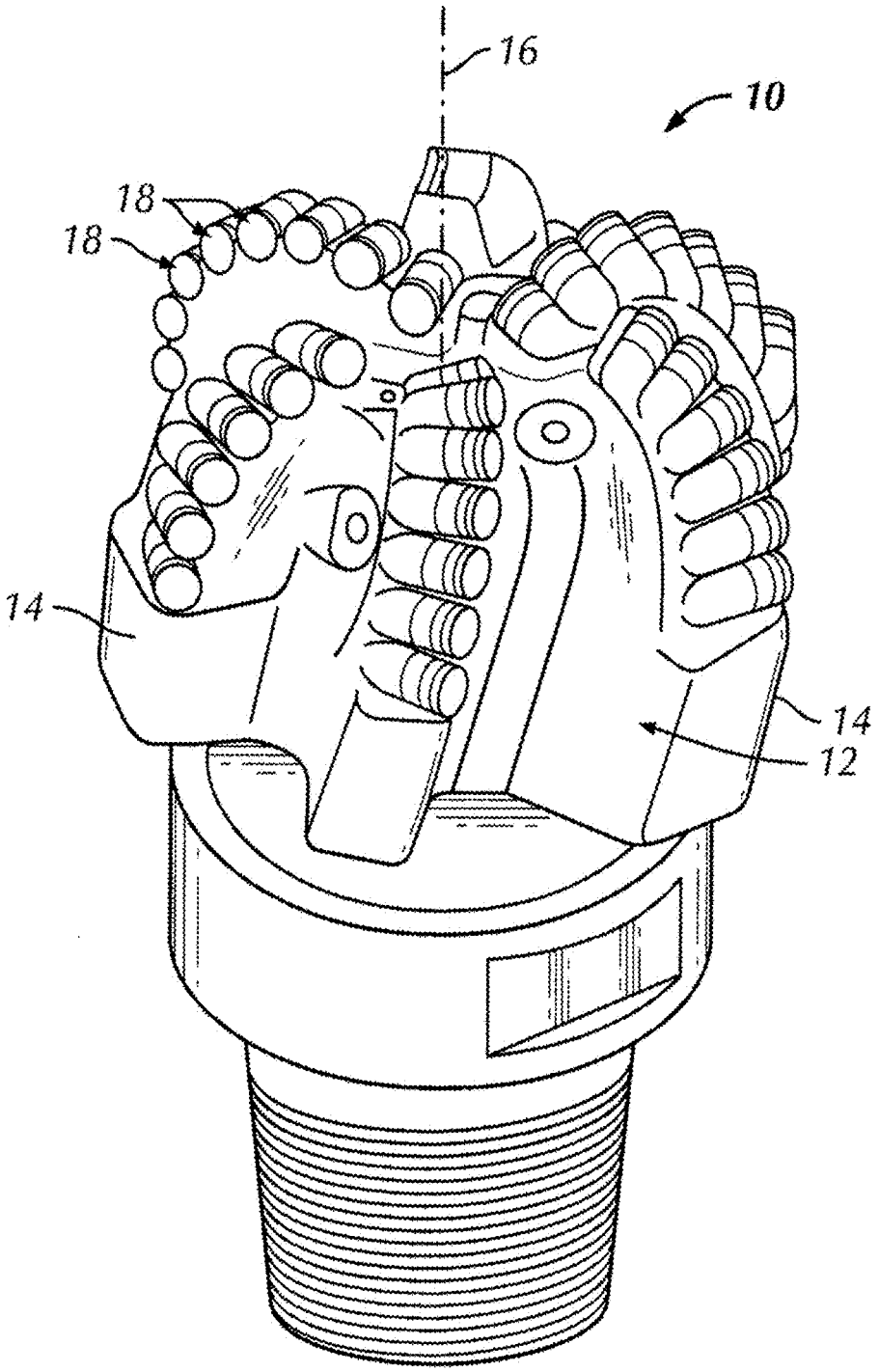
FIG. 1 is a perspective view of a PDC drill bit, according to some embodiments of the present disclosure.

Embodiments disclosed herein include cutting elements having one or more torque transmitting features formed in the working surface of the cutting, as well as drill bits and other cutting tools having such cutting elements attached thereto. The torque transmitting features formed in cutting elements of the present disclosure may allow for improved methods of attaching, removing, or positioning the cutting element to/from a cutting tool. According to some embodiments, cutting elements may further include additional features for improved attachment methods when attaching the cutting elements to cutting tools.

Cutting elements according to embodiments of the present disclosure may include an ultrahard material layer bonded to a substrate at an interface by a sintering process to form a table made of the ultrahard material bonded to the substrate. The table, including a working surface and cutting edge of the table, may be used for performing the cutting action of the cutting element, while the substrate may be used for attaching the cutting element to a cutting tool. The working surface is defined by a perimeter of the table, where the working surface is an outer surface of the table opposite from the interface between the table and substrate. A cutting element having an ultrahard material table bonded to a substrate at an interface may further include a base formed by an outer surface of the substrate opposite from the working surface and a side surface formed by the outer circumferential surfaces of the substrate and table, where the side surface may extend from the base to the working surface, terminating with the working surface at a beveled or angled cutting edge extending around the perimeter of the table.

A substrate may be made of a metal carbide material, such as cemented tungsten carbide. Cemented tungsten carbide may be formed by carbide particles being dispensed in a cobalt matrix, i.e., tungsten carbide particles are cemented together with cobalt. To form the substrate, tungsten carbide particles and cobalt are mixed together and then heated to solidify. The cemented tungsten carbide may be formed by mixing tungsten carbide particles with cobalt and then heating to form the substrate. In some instances, the substrate may be fully cured. In other instances, the substrate may be not fully cured, i.e., it may be green. In such case, the substrate may fully cure during the sintering process to bond an ultrahard material layer to the substrate. In other embodiments, the substrate may be in powder form and may solidify during the sintering process used to sinter the ultrahard material layer.

The ultrahard material layer may be made of, for example, diamond, such as PCD, polycrystalline cubic boron nitride ("PCBN"), or a thermally stable material such as thermally stable polycrystalline diamond ("TSP"). An ultrahard material layer may be bonded or otherwise coupled to a substrate using a sintering process to form a cutting element according to embodiments of the present disclosure. For example, to form a cutting element having an ultrahard material layer such as a PCD or PCBN hard material layer bonded to a cemented tungsten carbide substrate, diamond or cubic boron nitride ("CBN") crystals may be placed adjacent the cemented tungsten carbide body in a refractory metal enclosure (e.g., a niobium enclosure) and subjected to a high temperature and high pressures so that inter-crystalline bonding between the diamond or CBN crystals occurs forming a polycrystalline ultrahard material diamond or CBN layer. A catalyst or binder material may be added to the diamond or CBN particles to assist in inter-crystalline bonding. The process of heating under high pressure is known as sintering. Metals such as cobalt, iron, nickel, manganese and alike an alloys of these metals may be used as a catalyst matrix material for the diamond or CBN. Various other materials may be added to the diamond crystals, tungsten carbide being one example. In other embodiments, a press-fit or adhesive may be used to couple the ultrahard material layer to the substrate.

According to embodiments of the present disclosure, one or more depressions may be formed in a working surface of a cutting element and extend a depth into the cutting element, where a depression may have a cross-sectional profile perpendicular to its depth with a torque transmittable shape. The cross-sectional profile of a depression may vary along its depth, or may be constant/uniform along its depth.

As used herein, a torque transmittable shape refers to a shape that is capable of transmitting torque when a rotational force is applied. A depression having a cross-sectional profile with a torque transmittable shape may be referred to herein as a torque transmittable depression. In some embodiments, a torque transmittable shape may be a polygon, i.e., a shape bounded by three or more planar sides that terminate in pairs at the same number of vertices. In some embodiments, a torque transmittable shape includes a shape bounded by at least one planar side and at least one curved side, where the sides terminate in pairs at vertices. In some embodiments, a torque transmittable shape includes a shape bounded by two or more curved sides with constant radii of curvature, varying radii of curvatures, or combinations of constant and varying radii (and optionally with or without planar sides or portions thereof), where the sides terminate in pairs at vertices. In some embodiments, a torque transmittable shape may be formed of one curved side having varying radii of curvature, e.g., an ellipse or other oval shape (whereas a shape having a single curved side with a constant radii of curvature, i.e., a circle, would not be capable of transmitting torque from a rotational force). Examples of torque transmittable shapes may include but are not limited to star-shapes, rounded tip star shapes, slots, hexagons, rectangles, cross-shapes (e.g., Phillips screw slot shape), elongated ovals, and cassini ovals.

Figure 2:
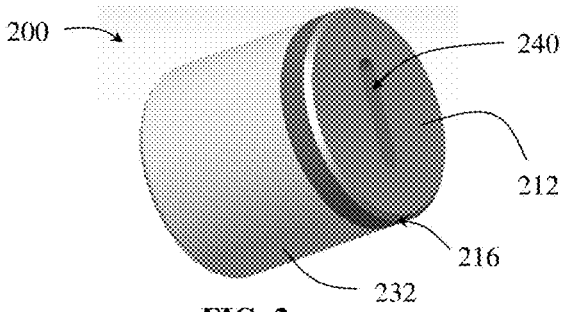
FIGS. 2-4 are various views of a cutting element according to some embodiments of the present disclosure.
Figure 3:
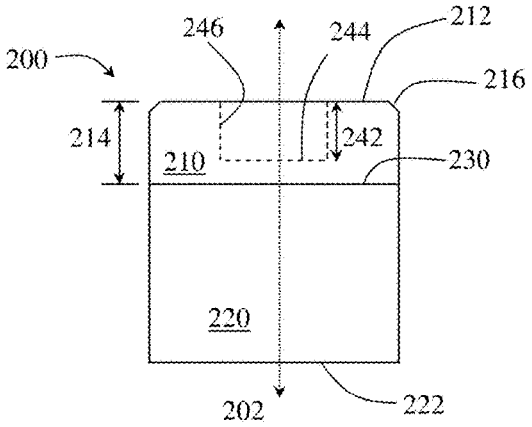
Figure 4:
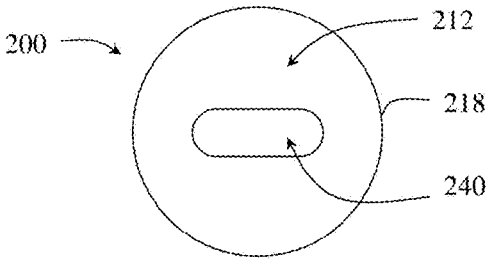

FIGS. 2-4 are views of an example of a cutting element according to embodiments of the present disclosure having a torque transmittable depression formed in its working surface, where the torque transmittable depression has a cross-sectional profile with a torque transmittable shape. FIG. 2 is a perspective view of cutting element 200; FIG. 3 is a side view of cutting element 200 along its length, with a torque transmittable depression 240 shown in dashed lines; and FIG. 4 is a top view of cutting element 200. As shown, the cutting element 200 includes a table 210 coupled to a substrate 220 at an interface 230 and a longitudinal axis 202 extending axially there through. The table 210 has a working surface 212 opposite the interface 230 and a table thickness 214 measured axially between the interface 230 and the working surface 212. An outer surface of the substrate 220 opposite the working surface 212 forms a base 222 of the cutting element 200. A circumferential side surface 232 of the cutting element 200 extends axially from the base 222 to the working surface 212, where the circumferential side surface 232 and the working surface 212 terminate at a cutting edge 216 extending around a perimeter 218 of the working surface 212. The cutting edge 216 may be beveled, as shown, or angled, where the working surface and side surface terminate at a right angle.

A torque transmittable depression 240 is formed in the working surface 212 a distance away from and interior to the perimeter 218 and extends a depth 242 into the cutting element 200. The depth 242 may be measured from the working surface 212 to a bottom surface 244 of the torque transmittable depression 240. In the embodiment shown, the depth 242 of the torque transmittable depression 240 is less than the thickness 214 of the table. According to some embodiments, however, the depth of a depression may be equal to the thickness of the table in which it is formed, extending to the interface between the table and the substrate, or the depth of a depression may be greater than the thickness of the table in which it is formed, extending into the substrate.

The torque transmittable depression 240 may have a cross-sectional profile perpendicular to its depth that is defined by a side wall 246 of the torque transmittable depression 240. A side wall may be formed of one or more sides, where two or more sides terminate in pairs at edges. For example, as seen in FIG. 4, the side wall 246 of the torque transmittable depression 240 has a single continuous side transitioning between planar and curved portions. The cross-sectional profile of the torque transmittable depression 240 may be defined by the intersection between a plane extending perpendicularly to a central axis of the depression and the side wall 246 of the depression. As shown in FIG. 4, the cross-sectional profile of the torque transmittable depression 240 has a pill shape. In some embodiments, a cross-sectional profile of a torque transmittable depression may be other Cassini oval shapes, rounded rectangle shapes, or stadium shapes.

In some embodiments, the cross-sectional profile of a depression may vary along the depth of the depression, where the cross-sectional profile of the depression at the working surface has a different size and/or shape than the cross-sectional profile of the depression at its bottom surface. For example, a depression may have a cross-sectional profile that gradually decreases in size along its depth from the working surface to the bottom surface of the depression. In some embodiments, such as shown in FIG. 3, a torque transmittable depression 240 may have a cross-sectional profile that is constant or uniform along its depth 242.

According to some embodiments, such as shown in FIGS. 2-4, a single torque transmittable depression may be formed in a working surface of a cutting element. The single torque transmittable depression may have a central axis that is coaxial with the longitudinal axis of the cutting element. For example, as shown in FIGS. 2-4, the cutting element 200 has a single torque transmittable depression 240 formed in the working surface 212, where a central axis of the torque transmittable depression 240 is coaxial with the longitudinal axis 202 of the cutting element 200. In some embodiments, however, such as discussed more below, a cutting element may have one or more depressions formed in its working surface with a central axis that is off-axis from the cutting element longitudinal axis.

Figure 5:
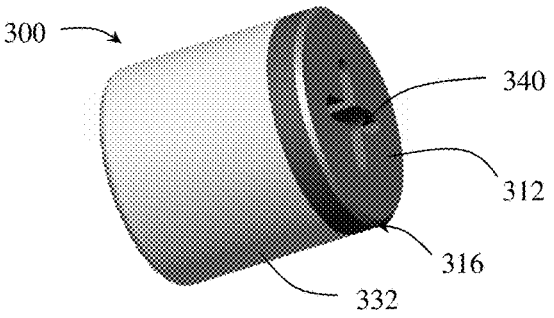
FIGS. 5-7 are various views of a cutting element according to additional embodiments of the present disclosure.
Figure 6:
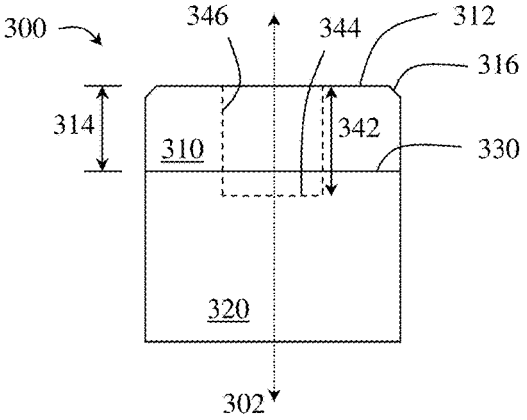
Figure 7:
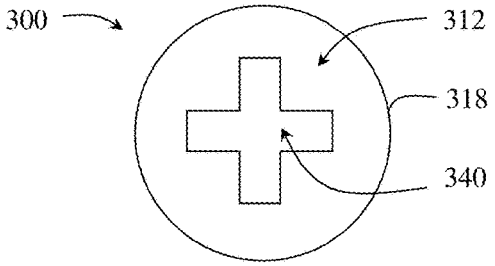

Referring now to FIGS. 5-7, another cutting element having a torque transmittable depression formed therein according to embodiments of the present disclosure is shown. FIG. 5 is a perspective view of cutting element 300; FIG. 6 is a side view of cutting element 300 along the length of the cutting element 300; and FIG. 7 is a top view of cutting element 300. As shown, the cutting element 300 includes a table 310 coupled to a substrate 320 at an interface 330 and a longitudinal axis 302 extending axially there through. The table 310 has a working surface 312 opposite the interface 330 and a table thickness 314 measured axially between the interface 330 and the working surface 312. A cutting edge 316 is formed around the perimeter 318 of the working surface 312, where the side surface 332 of the cutting element 300 meets the working surface 312. The cutting edge 316 may be beveled, as shown, or angled, where the working surface and side surface terminate at a right angle.

A torque transmittable depression 340 is shown in dashed lines and may be formed in the working surface 312 a distance away from and interior to the perimeter 318, and may extend a depth 342 into the cutting element 300. The depth 342 may be measured from the working surface 312 to a bottom surface 344 of the torque transmittable depression 340. In the embodiment shown, the depth 342 of the torque transmittable depression 340 is greater than the thickness 314 of the table 310, such that the torque transmittable depression 340 extends from the working surface 312, through the interface 330 and into the substrate 320, and such that the bottom surface 344 may be within the substrate rather than the table 310.

The torque transmittable depression 340 may have a cross-sectional profile perpendicular to its depth that is defined by a side wall 346 of the torque transmittable depression 340, where the side wall 346 is formed of a plurality of sides terminating in pairs at edges. As shown in FIG. 7, the cross-sectional profile of the torque transmittable depression 340 is a cross shape.

Figure 8:
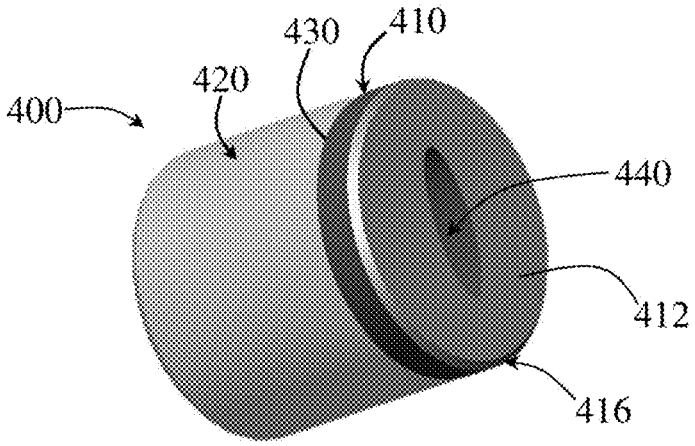
FIGS. 8 and 9 are various views of a cutting element according to further embodiments of the present disclosure.
Figure 9:
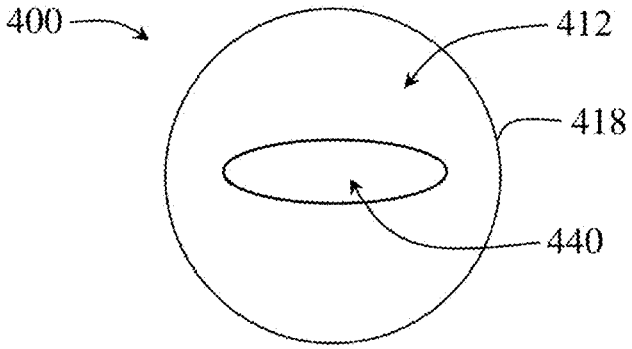

Referring now to FIGS. 8 and 9, another cutting element having a torque transmittable depression formed therein according to embodiments of the present disclosure is shown. FIG. 8 is a perspective view of cutting element 400, and FIG. 9 is a top view of cutting element 400. As shown, the cutting element 400 includes a table 410 coupled to a substrate 420 at an interface 430. The table 410 has a working surface 412 opposite the interface 430 and a cutting edge 416 formed around the perimeter 418 of the working surface 412. The table 410 may be a diamond table, e.g., a PCD or TSP diamond table, and the substrate 420 may be a sintered metal carbide substrate.

A torque transmittable depression 440 is formed in the working surface 412 a distance away from and interior to the perimeter 418 of the working surface 412 and extends a depth into the cutting element 400. The torque transmittable depression 440 has a cross-sectional profile with a torque transmittable shape, where the torque transmittable shape is formed of a single curved side with a varying radii of curvature. In some embodiments, a torque transmittable shape may be formed of multiple curved sides terminating in pairs at vertices, where the curved sides may have constant and/or varying radii of curvature.

Figure 10:
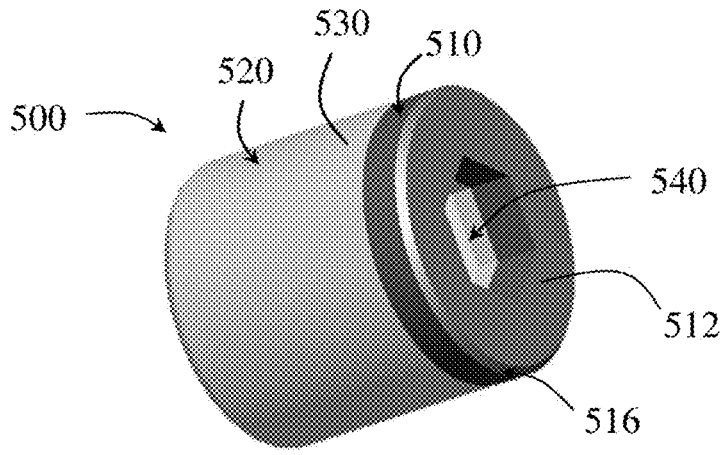
FIGS. 10 and 11 are various views of a cutting element according to some embodiments of the present disclosure.
Figure 11:
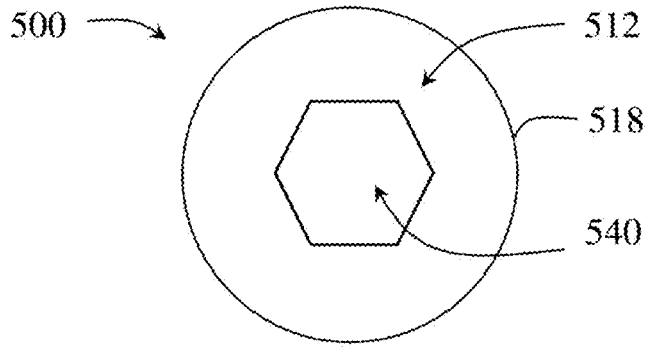

Referring now to FIGS. 10 and 11, another cutting element having a torque transmittable depression formed therein according to embodiments of the present disclosure is shown. FIG. 10 shows a perspective view of cutting element 500, and FIG. 11 shows a top view of cutting element 500. As shown, the cutting element 500 includes a table 510 coupled to a substrate 520 at an interface 530. The table 510 has a working surface 512 opposite the interface 530 and a cutting edge 516 formed around the perimeter 518 of the working surface 512.

A torque transmittable depression 540 is formed in the working surface 512 a distance away from and interior to the perimeter 518 and extends a depth into the cutting element 500. The torque transmittable depression 540 has a cross-sectional profile with a torque transmittable shape, where the torque transmittable shape is a polygon. The torque transmittable shape shown is a hexagon, however, other polygonal shapes may include a triangle, a rectangle, a pentagon, a heptagon or others.

According to embodiments of the present disclosure, a cutting element may include a table coupled to a substrate at an interface and a longitudinal axis extending axially there through, where at least two depressions may be formed in the working surface of the table. In embodiments having two or more depressions formed in the working surface of a cutting element, the depressions may have either a torque transmittable cross-sectional shape, or may have a circular cross-sectional shape (where a depression having a uniform circular cross-sectional shape along its depth may not independently transmit torque). Two or more depressions (whether independently being capable of transmitting torque or not being capable of independently transmitting torque) may together transmit torque applied by a rotational force. For example, two or more depressions may be formed in a working surface of a table around the longitudinal axis of a cutting element, where the depressions may be equi-spaced from the longitudinal axis. A tool having correspondingly shaped and spaced apart prongs to fit within the two or more depressions may be used to rotate the cutting element, where the multiple prongs of the tool inserted into multiple depression in the cutting element applies a rotational force on the cutting element, which is transmitted through the multiple depressions.

In some embodiments, multiple depressions may be formed in a working surface of a cutting element axisymmetrically around the longitudinal (and central) axis of the cutting element. Multiple depressions may be formed in a rotationally symmetric pattern about a cutting element longitudinal axis, where the depressions may have translation symmetry around the longitudinal axis (e.g., where the depressions have non-circular cross-sectional profiles) or discrete rotational symmetry of the nth order around the longitudinal axis, where n may include various rotation increments of 360° (e.g., 180°, 120°, 90°, 60°, and 30°).

Figure 12:
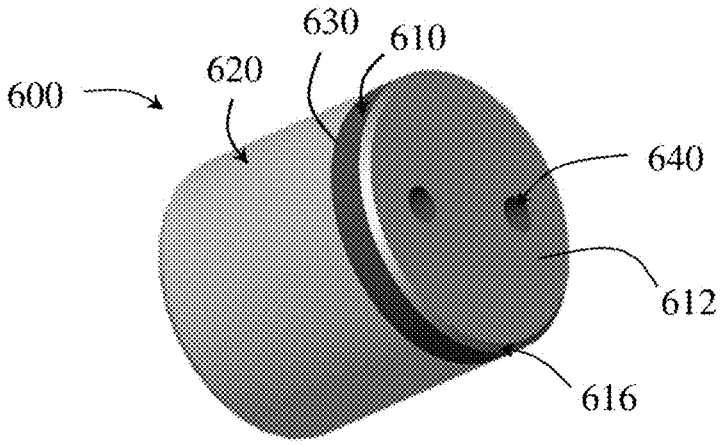
FIGS. 12 to 14 are various views of a cutting element according to additional embodiments of the present disclosure.
Figure 13:
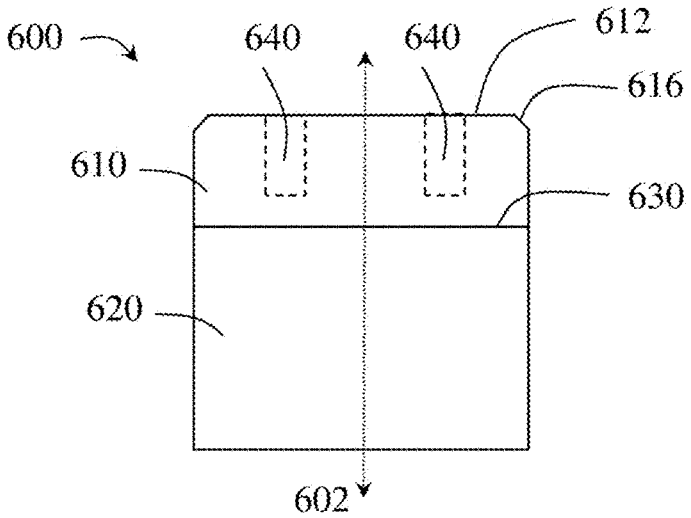
Figure 14:
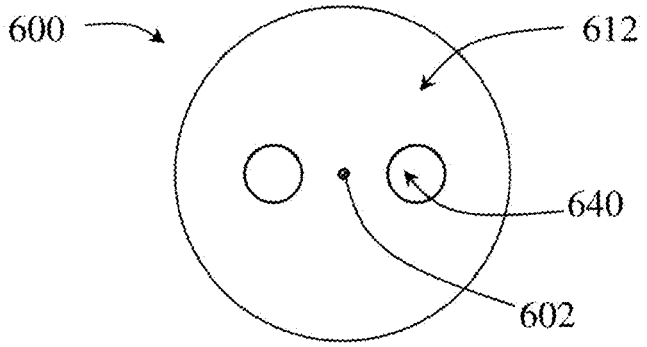

FIGS. 12-14 show an example of a cutting element having multiple depressions formed in its working surface, according to some embodiments of the present disclosure. The cutting element 600 includes a table 610 coupled to a substrate 620 at an interface 630, and a longitudinal axis 602 extending centrally therethrough. The table 610 has a working surface 612 opposite the interface 630 and multiple depressions 640 formed in the working surface 612, interior to a perimeter 618 of the working surface 612. In the embodiment shown, the cutting edge 616 extends the entire arc length around the perimeter 618 of the working surface 612, where one or more or each portion of the cutting edge 616 may contact a workpiece (e.g., a formation being drilled) during use of the cutting element 600, depending on, for example, the rotational position of the portions of the cutting edge 616 with respect to the tool to which the cutting element 600 is coupled (e.g., if the cutting element is rotatably or fixedly mounted to the tool) and the position of the cutting element 600 relative to the workpiece being cut during use of the cutting element.

The depressions 640 are space apart from each other and are both a distance away from the perimeter 618 of the working surface 612. In the embodiment shown, the depressions 640 extend an equal depth into the cutting element 600, where the depth of the depressions 640 is less than the thickness of the table 610. In other embodiments, multiple depressions formed in a cutting element working surface may have equal or unequal depths that extend less than, equal to, or greater than the thickness of the cutting element table. Further, the depressions 640 are equally spaced from the longitudinal axis 602 and in a rotationally symmetric pattern relative to the longitudinal axis 602. By providing depressions 640 in a rotationally symmetric pattern around the longitudinal axis 602, a tool having correspondingly shaped and spaced apart prongs to fit within the depressions 640 may be used to rotate the cutting element 600, where the prongs of the tool inserted into the depressions 640 may apply a substantially equal rotational force on each of the depressions 640 to rotate the cutting element 600 about its longitudinal axis 602.

According to other embodiments of the present disclosure, however, two or more depressions formed in the working surface of a cutting element interior to the working surface perimeter may be unequally spaced apart from a central longitudinal axis of the cutting element, or a single depression may be asymmetrically placed relative to the central longitudinal axis. Further, in some embodiments, cutting elements may have two or more depressions formed in a cutting element working surface interior to the working surface perimeter, where the depressions are positioned in a non-symmetrical pattern around the central longitudinal axis of the cutting element.

Figure 15:
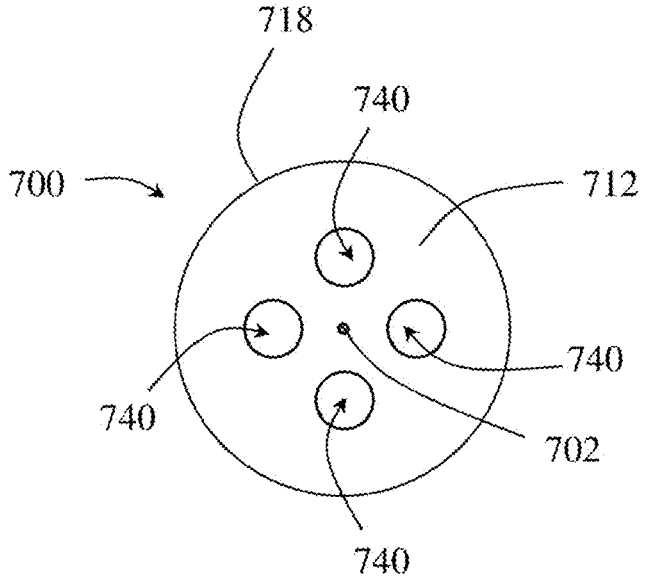
FIG. 15 is a top view of a cutting element according to some embodiments of the present disclosure.

The embodiment shown in FIGS. 12-14 includes a cutting element 600 having two depressions 640 interior to the working surface perimeter 618 and in a rotationally symmetric pattern around the central longitudinal axis 602. In other embodiments, however, a cutting element may have more than two depressions formed interior to the working surface perimeter and in a rotationally symmetric or asymmetric pattern around the central longitudinal axis. For example, FIG. 15 shows a top view of a cutting element 700 having four depressions 740 formed in the working surface 712 of the cutting element 700, where the depressions 740 are interior to the working surface perimeter 718 and in a rotationally symmetric pattern around the central longitudinal axis 702 of the cutting element 700. In some embodiments, multiple depressions may be formed in a cutting element working surface, interior to the working surface perimeter, where the depressions are in a non-symmetric pattern around the central longitudinal axis of the cutting element.

Further, according to some embodiments of the present disclosure, multiple depressions formed in a working surface of a cutting element may be formed around the perimeter of the working surface. In embodiments having two or more depressions formed around the perimeter of the working surface, a cutting edge may be formed around the perimeter of the working surface between pairs of neighboring (adjacent but not touching) depressions.

Figure 16:
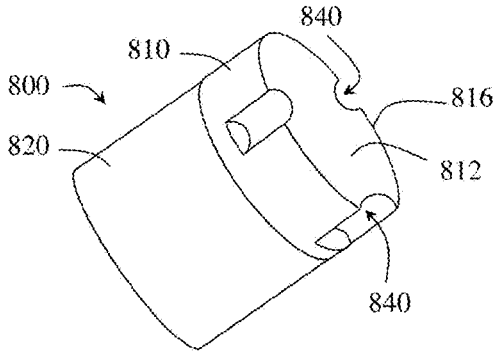
FIGS. 16-18 are various views of a cutting element according to further embodiments of the present disclosure.
Figure 17:
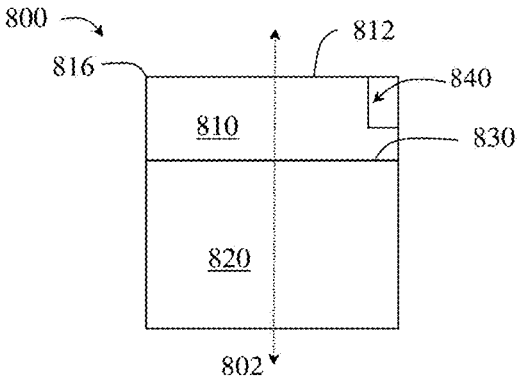
Figure 18:
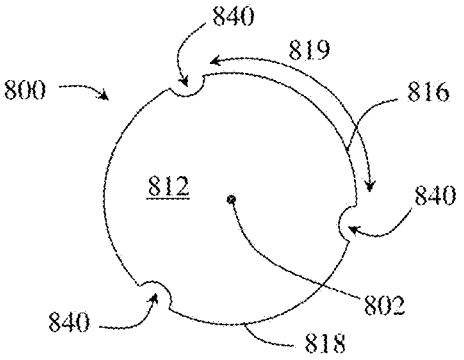

FIGS. 16-18 show an example of a cutting element according to embodiments of the present disclosure having multiple depressions formed around the perimeter of its working surface. The cutting element 800 includes a table 810 coupled to a substrate 820 at an interface 830 and a longitudinal axis 802 extending centrally there through. The table 810 has a working surface 812 opposite the interface 830 and multiple depressions 840 formed around the perimeter 818 of the working surface 812. The depressions 840 extend a depth into the cutting element 800 from the working surface 812. A cutting edge 816 is formed between the depressions 840 and along a partial arc length 819 of the perimeter 818 of the working surface 812, where the cutting edge 816 is formed by the intersection of the working surface 812 with the circumferential side surface of the cutting element 800. Portions of the perimeter 818 forming the cutting edge 816 may contact a workpiece (e.g., a formation being drilled) during use of the cutting element 800 to perform at least part of the cutting action of the cutting element 800.

In the embodiment shown, three depressions 840 are equi-spaced around the perimeter 818 of the working surface 812 such that portions of the perimeter 818 between neighboring depressions 840 forming the cutting edge 816 have substantially equal arc lengths. According to other embodiments of the present disclosure, two or more depressions formed around a perimeter of a cutting element working surface may be unequally spaced apart from each other around the perimeter.

Cutting elements having multiple depressions formed around the perimeter of the working surface may have at least one circumferential cutting edge formed between neighboring depressions having an arc length around the perimeter equal to or greater than $\pi/2$ times the radius of the working surface, e.g., at least $(2/3)\pi$ times the radius of the working surface. In some embodiments, two or more depressions formed around a perimeter of a cutting element working surface may be spaced apart from each other around the perimeter by at least 82° relative to a central longitudinal axis of the cutting element. In some embodiments, two or more depressions formed around a perimeter of a cutting element working surface may be spaced apart from each other around the perimeter by at least 120° relative to a central longitudinal axis of the cutting element. In some embodiments, two or more depressions formed around a perimeter of a cutting element working surface may be spaced apart from each other around the perimeter by at least 150° relative to a central longitudinal axis of the cutting element. For example, the embodiment shown in FIG. 18 has three depressions 840 equally spaced apart from each other around the perimeter 818 by 120° relative to the longitudinal axis 802. In other embodiments, two or three or more than three depressions may be equally or unequally spaced apart from each other around the perimeter by between 80° and 120°. In some embodiments, two depressions may be equally (i.e., 180° apart) or unequally spaced apart from each other around the perimeter of a cutting element working surface.

According to embodiments of the present disclosure, the working surface of a cutting element table may have a second material, different from the material forming the cutting element table, within the depression(s). The second material may optionally include or form a plug, which is a preformed piece inserted into a depression after the depression has been formed in the cutting element table, or the second material may be formed in the cutting element table. For example, according to embodiments of the present disclosure, a cutting element may include a table coupled to a substrate at an interface, a working surface formed by the table opposite the interface and defined by a perimeter, and a table thickness measured between the interface and the working surface, where the working surface has a first material forming the perimeter of the working surface and an interior portion formed of a second material, the interior portion being interior to the perimeter. The second material may completely fill one or more depressions formed in the first material, or the second material may partially fill one or more depression formed in the first material. Further, the second material may have a higher machinability than the first material.

As used herein, machinability refers to the ease with which a material can be machined. Machinability is not a material property in the same sense as traditionally referred to material properties, inherent to a material. Instead, machinability may depend on the material properties of the material itself as well as the cutting conditions of the material. For example, machinability of a material may depend on the material's ductility, hardness, and wear resistance. Examples of factors that may indicate greater machinability may include, but are not limited to, low hardness, low yield strength, high modulus of elasticity, high thermal conductivity, low wear resistance, or combinations of the foregoing. Using American Iron and Steel Institute (AISI) standards, machinability may be expressed as a percentage or a normalized value.

Figure 19:
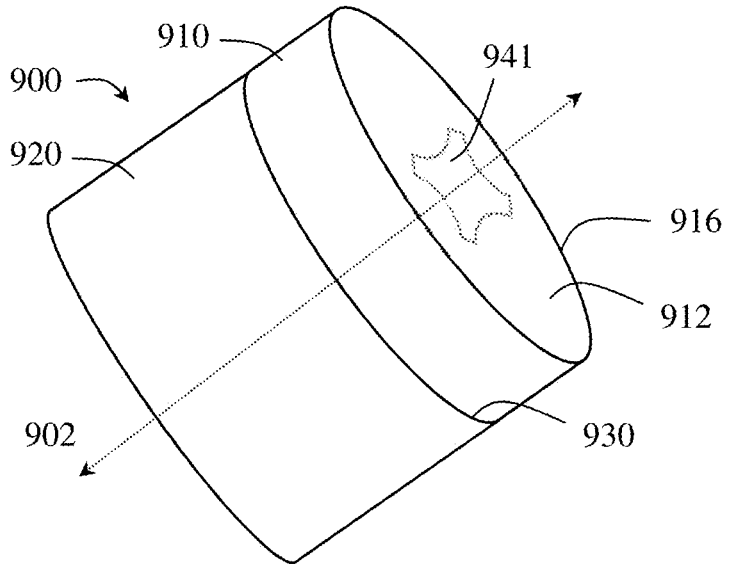
FIGS. 19 and 20 are various views of a cutting element according to some embodiments of the present disclosure.
Figure 20:
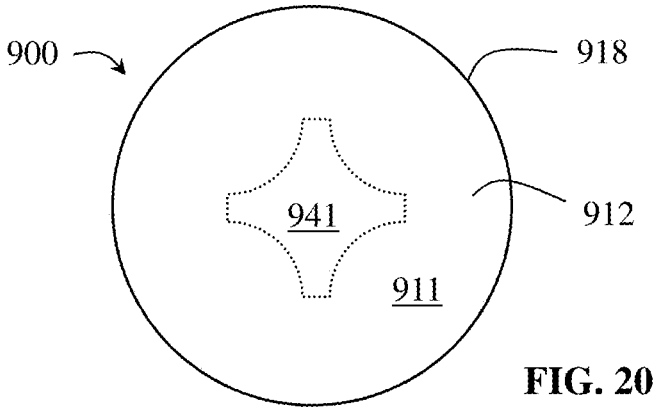

Referring to FIGS. 19 and 20, an example of a cutting element according to embodiments of the present disclosure having a working surface formed of two different materials is shown. FIG. 19 shows a perspective view of the cutting element 900; and FIG. 20 shows a top view of the cutting element 900. The cutting element 900 includes a table 910 coupled to a substrate 920 at an interface 930 and a longitudinal axis 902 extending centrally there through. The table 910 includes a working surface 912 formed opposite the interface 930, where a table thickness is measured between the interface 930 and the working surface 912. The working surface 912 has a cutting edge 916 extending around its perimeter 918.

The working surface 912 is formed of a first material 911 and a second material 941, where the first material 911 forms the perimeter 918 (and cutting edge 916) of the working surface 912, and the second material forms an interior portion of the working surface 912, the interior portion being interior to and a distance apart from the perimeter 918. The second material 941 has a higher machinability than the first material 911. For example, the second material 941 may be formed of sintered metal carbide, a diamond composite material, a polymer, a ceramic, or a metal, whereas the first material 911 may be formed of a diamond composite material having a greater hardness than the second material, PCD, TSP, or other ultrahard material having a greater hardness than the second material.

In some embodiments, the second material 941 and the first material 911 may be formed together during formation of the table 910. For example, in some embodiments, a cutting element table may be formed by positioning a first material starter material (e.g., a powder or paste mixture of diamond particles) and a second material starter material (e.g., a powder or paste mixture of carbide particles or a composite material mixture in powder or paste form) in a mold of the table. The first material starter material may be positioned in areas of the mold corresponding to the table's cutting edge, and the second material starter material may be positioned in an area of the mold corresponding to an interior portion of the table's working surface. For example, a second material starter material may be placed in an interior portion of a wall of the mold corresponding to the table's working surface (e.g., where the second material starter material may hold its shape by being provided in paste or clay form, for example, with the use of binders and/or adhesives mixed together with the second material starter material), and a first material starter material may be placed circumferentially around the second material starter material. The first and second material starter materials may then be sintered to form the table in a single sintering process. The table may be sintered to a substrate in a separate sintering process or in the sintering process used to form the table. For example, in some embodiments, a substrate may be formed together with the table by providing a substrate starter material adjacent to the table starter materials and sintering the substrate and table starter materials together in a single sintering process to form a cutting element having a table bonded to a substrate at an interface, such as described herein. In some embodiments, a pre-formed substrate may be positioned adjacent to table starter materials, where the pre-formed substrate may be sintered to a table by the sintering process used to sinter the table starter materials into the table.

A second material formed together with a surrounding first material to form a cutting element table may be selected to have a greater fracture toughness than the first material, for example, to inhibit crack propagation through the cutting element table during use of the cutting element. In some embodiments, a second material formed together with a surrounding first material to form a cutting element table may be subsequently removed (e.g., by machining the second material out of the first material) to leave one or more depressions formed in the cutting element table.

According to embodiments of the present disclosure, a second material may be preformed into a plug piece to partially or completely fill a depression formed in a cutting element table formed of a first material. For example, a table may be formed of a first material, where one or more depressions may be formed in the working surface of the table either during formation of the table (e.g., with use of a mold having correspondingly shaped and positioned depression-forming portions) or after formation of the table (e.g., by machining the depression(s) into the table after its formation). A second material preformed into a plug may then be inserted into a formed depression, either partially or completely filling the depression. In embodiments where a second material partially fills a depression formed in a first material table, the second material may be preformed into a shape that corresponds with and fits into a portion of the depression (e.g., by pre-forming the second material into a plug that corresponds in shape with and fits into an upper portion of the depression). In some embodiments where a second material completely fills a depression formed in a first material table, the second material may be preformed into a shape that corresponds with and fits into the entire depression. One or more second material plugs may be inserted into one or more depressions formed in a first material table, such that the upper surfaces of the first and second materials are flush, thereby forming a single planar working surface.

A second material plug may extend a depth from a cutting element working surface into the cutting element that is less than, equal to, or greater than the thickness of the cutting element table. In embodiments having a second material plug partially filling a depression formed in a first material table, the depression may extend a depth from the working surface into the cutting element farther than that of the second material, such that a gap is formed between a bottom surface of the depression and a bottom surface of the second material plug.

According to embodiments of the present disclosure, a second material plug in a depression formed in a first material table may be used to cover a full or partial portion of the depression, for example, to limit and potentially prevent debris from collecting in the depression. The second material plug may be subsequently removed (e.g., after use of the cutting element) to expose the depression. For example, in embodiments having a cutting element with a second material plug in an interior portion of a first material along the cutting element working surface, the second material plug may be removed to expose a torque transmittable depression formed in the first material working surface. The second material plug may be removed by pulling or dislodging the second material plug out of the torque transmittable depression formed in the first material as an intact piece or by machining out the second material plug. Torque may be applied to the exposed torque transmittable depression, for example, to remove or rotate the cutting element. Accordingly, in some embodiments, a second material plug forming an interior portion of a cutting element working surface may have a torque transmittable cross-sectional profile, such that when the second material plug is removed, a depression having a corresponding torque transmittable cross-sectional profile remains extending a depth into the first material from the working surface.

In addition to or instead of using a depression formed in a cutting element's working surface to transmit torque, a depression may be used to hold one or more sensors. For example, as described above, embodiments of the present disclosure may include one or more depressions formed in an interior portion of a cutting element's working surface and/or around a perimeter of a cutting element working surface. In embodiments having one or more depressions formed in an interior portion of a cutting element working surface, a depression may be used to transmit torque, such as described above, and/or a depression may be used to hold one or more sensors.

Figure 21:
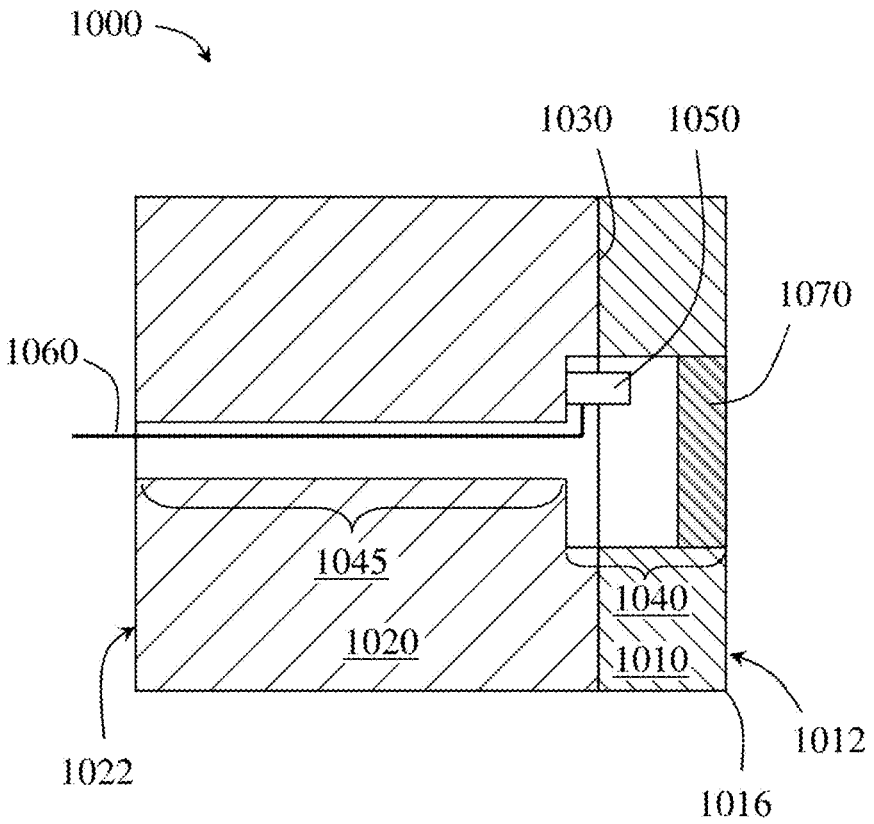
FIG. 21 is a cross-sectional view of a cutting element according to some embodiments of the present disclosure.

Referring now to FIG. 21, an example of a cutting element according to embodiments of the present disclosure is shown, where a sensor is in a depression formed in the working surface of the cutting element. FIG. 21 shows a cross-sectional view of cutting element 1000 that includes a table 1010 coupled to a substrate 1020 at an interface 1030. The table 1010 includes a working surface 1012 formed opposite the interface 1030, where a table thickness is measured between the interface 1030 and the working surface 1012. The working surface 1012 has a cutting edge 1016 extending around its perimeter.

A depression 1040 is formed in the working surface 1012, interior to the perimeter of the working surface 1012, and extends a depth into the cutting element 1000. A through-hole 1045 extends from a bottom surface of the depression 1040 to a base 1022 of the substrate 1020, such that openings of the through-hole communicate with the bottom surface of the depression 1040 and an outer surface at the base 1022 of the substrate 1020. Sensor 1050 is fully or partially in the depression 1040, and optionally is positioned below the outer surface of the plug 1070 and/or the working surface 1012. In some embodiments, the sensor 1050 may be fully or partially in the through-hole 1045. As shown in FIG. 21, a wire 1060 may extend from the sensor 1050 and fully or partially through the through-hole 1045, which may be used to transmit signals from the sensor 1050. In some embodiments, the sensor 1050 may wirelessly transmit signals, for example, to a storage device or a transmitting device within range of the sensor, and thus the through-hole may not be included or used. Sensors used in embodiments of the present disclosure may include, for example, accelerometers, temperature sensors, pressure sensors, weight/load sensor, strain gauges, other sensors, or combinations of the foregoing, which may transmit information related to performance of the cutting element and/or cutting tool to which the cutting element is coupled (e.g., bit vibration, temperature at the working surface, bit whirl, weight on bit, etc.).

A plug 1070 may be within the depression 1040 to cover the sensor 1050, such that the sensor 1050 is positioned in a gap formed between the bottom surface of the depression 1040 and a bottom surface of the plug 1070. The sensor 1050 may have a smaller volume than the gap formed between the bottom surface of the depression 1040 and the bottom surface of the plug 1070, such that a portion of the gap remains unfilled, such as shown in FIG. 21. In some embodiments, a sensor may have a volume substantially equal to and fit within the volume of a gap formed between a depression and a plug, such that the entire gap is filled with the sensor. In some embodiments, a sensor may be embedded in a plug.

The plug 1070 has a corresponding cross-sectional shape as the depression 1040 in which it is positioned, such that the plug 1070 fits within and optionally seals the depression 1040. An upper surface of the plug 1070 may be flush with and partially form the cutting surface 1012. In some embodiments, however, a plug may be within a depression formed in a cutting element working surface, where an upper surface of the plug is not flush with the working surface. For example, an upper surface of a plug within a depression formed in a cutting element working surface may be a depth beneath the working surface.

The table 1010 is formed of a first material, and the plug 1070 is formed of a second material, such that the perimeter (and cutting edge 1016) of the working surface 1012 is formed of the first material and an interior portion of the working surface 1012 is formed of the second material, the interior portion being interior to and a distance apart from the perimeter. The second material (and plug 1070) may be formed of, for example, sintered metal carbide, a polymer, a ceramic, or a metal, and the first material may be formed of diamond, for example.

Cutting elements according to the present disclosure may have various sizes. For example, cutting elements may have an outer diameter ranging from 9 mm (0.4 in) to 25 mm (1 in), for example, 13 mm (0.5 in), 16 mm (0.6 in), 19 mm (0.7 in), or 20 mm (0.8 in), or may be less than 9 mm (0.4 in) or greater than 25 mm (1 in). Cutting elements may include a table of an ultrahard material having a thickness range, for example, from a lower limit selected from 1.5 mm (0.05 in), 6 mm (0.2 in), or 8 mm (0.3 in) to an upper limit selected from 10 mm (0.4 in), 15 mm (0.6 in), 20 mm (0.8 in) or 25 mm (1 in). A cutting element may also be made entirely of diamond material, such as entirely from PCD, without the use of a substrate. According to embodiments of the present disclosure, a depth of a depression formed in the working surface of a cutting element may range, for example, from a lower limit selected from 5 percent, 15 percent, 20 percent or 25 percent of the entire length of the cutting element to an upper limit selected from 25 percent, 50 percent or 75 percent of the entire length of the cutting element, depending on, for example, the entire length of the cutting element and the size and/or shape of the depression cross-sectional profile. Other sizes of cutting elements and cutting element features may be provided with one or more depressions formed in the working surface according to embodiments of the present disclosure.

One or more cutting elements according to embodiments of the present disclosure may be attached to a cutting tool, for example, by rotatably attaching the cutting element to the cutting tool (i.e., where the cutting element is allowed to rotate with respect to a rotational axis extending through the cutting element while at the same time being retained to the cutting tool), by mechanically attaching the cutting element to the cutting tool, or by brazing the cutting element to the cutting tool. Downhole cutting tools, such as drill bits (e.g., fixed cutter bits), reamers, mills, and other hole opening devices, may have one or more cutting elements in accordance with embodiments disclosed herein attached thereto. Other cutting tools suitable for use with fixed cutting elements, such as PDC cutters, may have one or more cutting elements in accordance with embodiments disclosed herein attached thereto.

Methods of attaching a cutting element according to embodiments of the present disclosure to a cutting tool may include brazing the cutting element within a cutter pocket formed in a cutting tool body, where torque may be applied to the cutting element via one or more torque transmitting features during brazing.

For example, cutting elements having at least one depression formed in its working surface may be rotated via the depression(s) during brazing the cutting elements to a cutting tool to allow for improved brazing and thus attachment to the cutting tool. Brazing cutting elements according to embodiments of the present disclosure to a cutting tool may include positioning one or more braze materials between a cutting element of the present disclosure and a cutter pocket formed in the cutting tool. The braze material may be melted, and while the braze material is melted, the cutting element may be rotated within the cutter pocket via one or more depressions formed in its working surface (e.g., a torque transmittable depression, two or more depressions formed in an interior portion of the working surface, or two or more depressions formed around the perimeter of the working surface). Upon solidification of the braze material, the braze material bonds the cutting element to the cutter pocket.

Rotating the cutting element while the braze material is melted may allow for improved and more uniform spreading of the braze material between the cutting element and the cutter pocket, as well as reduced incidences of air pockets. Further, rotating the cutting element during brazing may be more easily achieved as well as more reliably controlled when rotating via the one or more depressions formed in the cutting element working surface, for example, when compared to trying to grip a smooth uniform surface of a cutting element to rotate the cutting element.

Metal alloys used as braze material may include, for example, copper, nickel, silver, or gold based alloys. Braze material may include base metals selected from silver, copper, gold, and nickel, and may also include as other constituents at least one of tin, zinc, titanium, zirconium, nickel, manganese, tellurium, selenium, antimony, bismuth, gallium, cadmium, iron, silicon, phosphorous, sulfur, platinum, palladium, lead, magnesium, germanium, carbon, oxygen, as well as other elements. Generally, gold-, nickel-, and copper-based alloys may be used as high temperature braze materials, whereas silver-based alloys may have braze temperatures of less than or more than 700° C.

According to some embodiments, one or more cutting elements according to embodiments of the present disclosure may be mechanically attached to a cutting tool, for example, by press fitting, threaded attachments, other mechanical attachment features, or combinations of the foregoing. In some embodiments, a cutting element having at least one depression formed in its working surface may be mechanically attached to a cutting tool using a shaft. For example, in some embodiments, a cutting element may be threadably attached to a cutting tool via a threaded shaft and corresponding threaded cavity. In some embodiments, a threaded shaft may be attached to a substrate of a cutting element according to embodiments of the present disclosure, for example, by interference/press fitting the threaded shaft to a base surface of the substrate, or by forming a shaft with the substrate body.

Figure 22:
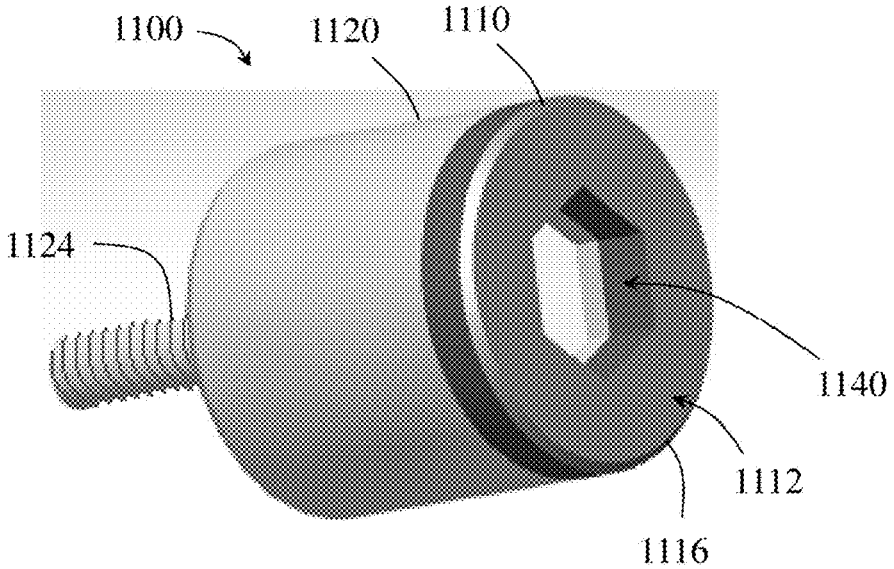
FIG. 22 is a perspective view of a cutting element according to some embodiments of the present disclosure.
Figure 23:
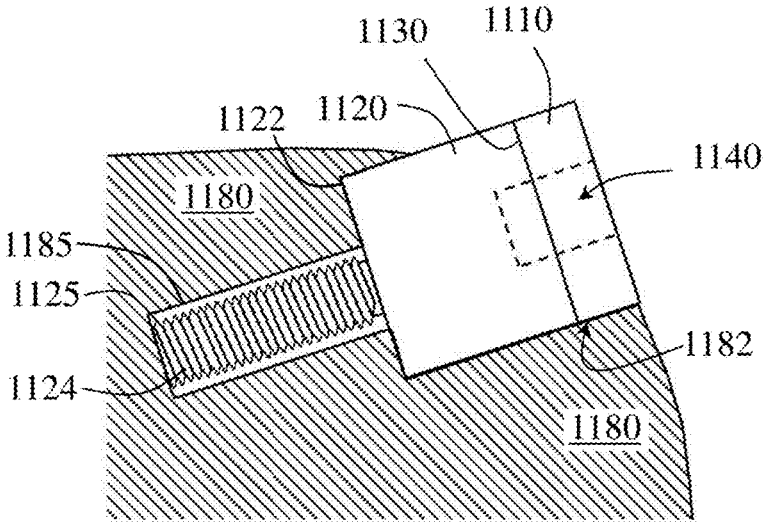
FIG. 23 is a cross-sectional view of the cutting element of FIG. 22 mounted to a cutting tool, according to some embodiments of the present disclosure.

FIGS. 22 and 23 show an example of a cutting element 1100 that may be mechanically coupled to a drill bit, underreamer, mill, or other cutting tool 1180. The cutting element 1100 has a table 1110 coupled to a substrate 1120 at an interface 1130 and a torque transmittable depression 1140 formed in its working surface 1112. In the embodiment shown, the torque transmittable depression 1140 is formed in an interior portion of the working surface 1112, interior to a cutting edge 1116 extending around the perimeter of the working surface. In other embodiments, however, one or more depressions may be formed in other shapes, sizes, or locations along the working surface, including interior to the working surface perimeter and/or along the working surface perimeter, such as discussed above.

A shaft 1124 extends outwardly from a base 1122 of the substrate 1120, and away from the table 1110, which may define a cutting face or working surface 1112. The shaft may be attached at the base of the substrate, for example, by press fitting an end of the shaft into a cavity formed in the base of the substrate or by providing a threaded connection between an end of the shaft and a cavity formed in the base of the substrate. In some embodiments, the shaft 1124 may be formed with the substrate 1120, where the substrate 1120 and the shaft 1124 are an integral piece. In some embodiments, the shaft 1124 may have a diameter than is about equal to the diameter of the substrate 1120. In other embodiments, the shaft 1124 may have a diameter that is less than the diameter of the substrate 1120. For instance, the diameter of the shaft 1124 may be between 20% and 75% of the diameter of the substrate 1120.

The cutting element 1100 may be attached to a cutter pocket 1182 formed in the cutting tool 1180, such that the working surface 1112 of the cutting element is exposed along an outer face of the cutting tool. The cutter pocket 1182 may have a corresponding negative shape to the cutting element 1100, such that the cutting element 1100 may fit within the cutter pocket 1182. Further, a cavity 1185 may be formed at a base of the cutter pocket 1180, which may be configured to receive the shaft 1124 extending from the base 1122 of the substrate 1120. At least a portion of the shaft 1124 extending outwardly from the base 1122 of the substrate 1120 may be threaded 1125, where the threaded portion 1125 of the shaft 1124 may be threaded to a correspondingly threaded portion of the cavity 1185, thereby attaching the cutting element 1100 to the cutting tool 1180 via the threaded shaft 1124 and cavity 1185 connection.

Other mechanical means of attaching a cutting element according to embodiments of the present disclosure to a cutting tool may be used, with or without the use of a shaft. For example, one or more fasteners may be used to mechanically retain a cutting element of the present disclosure to a cutting tool, e.g., where a fastener may extend partially through the cutting tool body and into a portion of the cutting element substrate.

Further, in some embodiments, a cutting element according to the present disclosure may be rotatably mounted to a cutter pocket formed in a cutting tool, where the cutting element may be allowed to rotate within the cutter pocket while also being retained to the cutter pocket. A cutting element having at least one depression formed in its working surface may be rotatably retained to a cutting tool, for example, using one or more retention mechanisms. Retention mechanisms suitable for rotatably retaining a cutting element according to embodiments of the present disclosure may include, for example, pins, balls, springs, rings, or clips, such as described in U.S. Patent Publication Nos. 2014/0174834, 2014/0326516 and 2014/0374169 and U.S. Pat. Nos. 9,033,070 and 9,187,962, for example.

Figure 24:
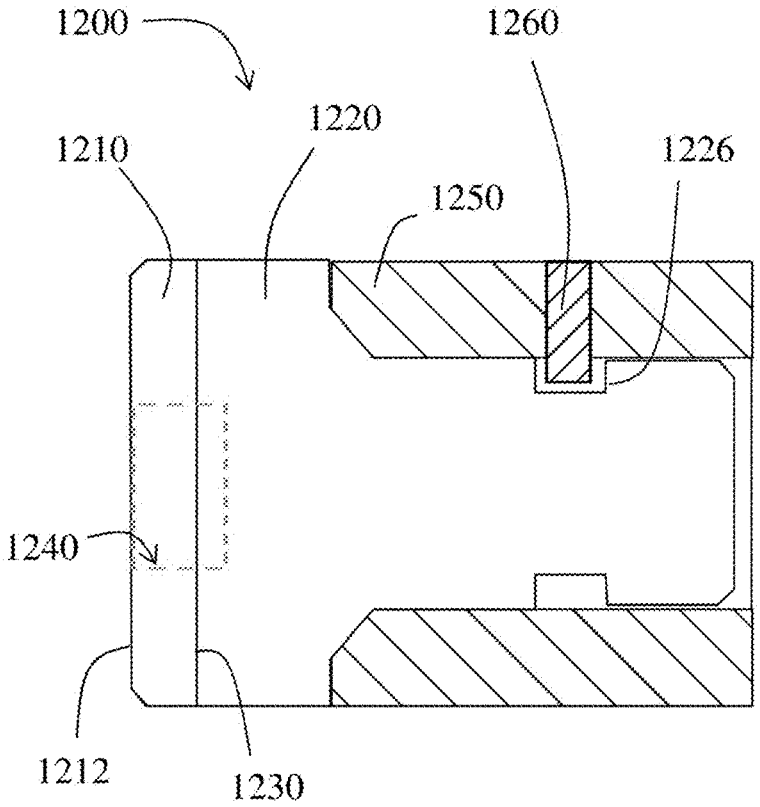
FIG. 24 is a cross-sectional view of a cutting element according to some embodiments of the present disclosure.

FIG. 24 shows an example of a cutting element according to embodiments of the present disclosure configured to be rotatably mounted to a cutting tool. The cutting element 1200 has a table 1210 coupled to a substrate 1220 at an interface 1230 and a torque transmittable depression 1240 formed in its working surface 1212. The embodiment shown in FIG. 24 has a single torque transmittable depression 1240 formed in an interior portion of its working surface 1212. In some embodiments, however, two or more depressions may be formed along the perimeter of a working surface, such as shown and described above with reference to FIGS. 16-18, on a cutting element that is rotatably retained to a cutting tool. As described above, depressions formed along a working surface perimeter may be spaced apart around the perimeter by at least 80° relative to a central longitudinal axis of the cutting element, for example, to provide a suitably sized cutting edge between neighboring depressions. By providing depressions along an exposed working surface perimeter of a cutting element mounted to a cutting tool, gripping tools may be capable of gripping the cutting element by the depressions, and in some instances, may be used for pulling the cutting element out of a cutter pocket (e.g., to replace the cutting element).

A circumferential groove 1226 is formed around a portion of the substrate 1220. The cutting element 1200 may be fully or partially disposed in an outer support member 1250. An outer support member may be a cutter pocket in some embodiments, or in some embodiments, an outer support member may be a separate piece from a cutter pocket, where the cutting element assembled to the separate piece outer support member may be mounted to a cutter pocket of a cutting tool. When the cutting element 1200 is partially disposed in the outer support member 1250, a retention mechanism 1260 may extend from the outer support member 1250 and into the circumferential groove 1226, where the circumferential groove 1226 may rotate adjacent to the retention mechanism 1260 while also be axially retained by the retention mechanism 1260 (to inhibit the cutting element from axially dislodging from the outer support member 1250). A retention mechanism 1260 may be a pin that extends through the outer support member 1250 and into the circumferential groove 1226, as shown in FIG. 24. In other embodiments, one or more retention mechanisms may be used (e.g., between axially aligned circumferential grooves formed around a portion of a cutting element and around an inner wall of a support member, formed integrally with an outer support member inner wall to protrude into a circumferential groove formed around a portion of a cutting element, or formed integrally with a portion of a cutting element substrate to protrude into a circumferential groove formed around an inner wall of a support member). Further, in some embodiments, one or more retention mechanisms may include a ball, pin, spring, other retention mechanism, or any combination of the foregoing.

Cutting elements according to embodiments of the present disclosure may have a generally cylindrical shape, such as shown in FIGS. 2, 5, and 12, or a non-cylindrical shape. According to some embodiments, cutting elements may have a non-cylindrical shape that may either be rotatable within a cutter pocket or non-rotatable within a cutter pocket. For example, the cutting element shown in FIGS. 22 and 23 has a shaft extending from a base of the substrate, which may be used to attach the cutting element to a cutting tool. FIG. 24 shows another example of a non-cylindrical cutting element, where the cutting element includes a table and support portion of the substrate having a larger diameter than a shaft portion of the substrate, and where a circumferential groove formed around the shaft portion of the substrate allows the cutting element to be rotatably mounted to a cutting tool.

Figure 25:
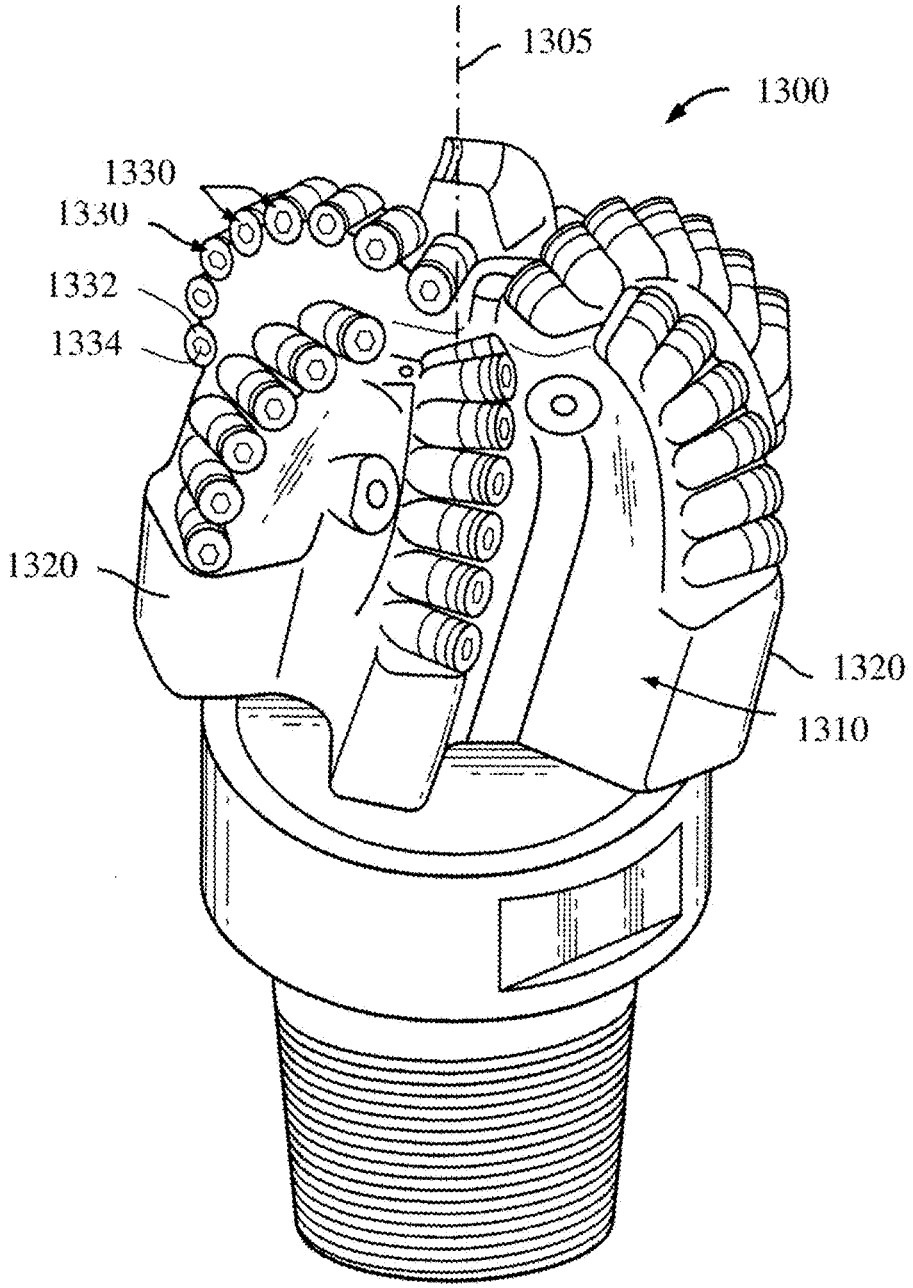
FIG. 25 is a perspective view of a cutting tool according to some embodiments of the present disclosure.

According to embodiments of the present disclosure, a cutting tool may include one or more cutting elements mounted thereto, where the cutting element(s) have one or more depressions formed in the working surface and exposed along an outer face of the cutting tool. For example, FIG. 25 shows a cutting tool according to embodiments of the present disclosure, where the cutting tool is a drill bit 1300 having a bit body 1310 with a plurality of blades 1320 extending in an outwardly direction and a longitudinal axis 1305 extending axially through the bit body 1310. Each blade has a leading side (facing in the direction of bit rotation), a trailing side opposite the leading side, and an outer side extending between the leading and trailing sides. The bit 1300 includes a plurality of cutter pockets formed in the body 1310, in rows along the outer sides of the blades 1320. A cutting element 1330 is in each of the cutter pockets such that the working surface 1332 of each cutting element 1330 is exposed to a cutting face of the drill bit 1300 (i.e., a face or outer surface of the drill bit that may contact a workpiece, such as a formation being drilled). As shown, the working surfaces 1332 of the cutting elements 1330 are substantially aligned with and face in the same direction as the leading sides of the blades 1320. Each working surface 1332 has a torque transmittable depression 1334 formed therein, where the torque transmittable depression 1334 is exposed along the leading side of the blade 1320. According to one or more embodiments, however, at least one but less than the full number of cutting elements coupled to a cutting tool may include a depression formed in the working surface.

Further, according to embodiments of the present disclosure, a cutting tool may include one or more cutting element (s) having other types and/or number of depressions formed in the working surface, such as described herein. For example, according to some embodiments of the present disclosure, a cutting tool may have one or more cutting elements with two or more depressions formed around the perimeter of the cutting element working surface, where the depressions may be exposed to along an outer face of the cutting tool.

The cutting tool shown in FIG. 25 is a drill bit; however, other cutting tool types may have one or more cutting elements according to the present disclosure mounted thereto, where one or more depressions formed in a cutting element working surface (e.g., in an interior portion of the working surface and/or along the perimeter of the working surface, such as discussed above) may be exposed along an outer face of the cutting tool.

In the description and claims, the terms "including," "having," and "comprising" are used in an open-ended fashion, and thus should be interpreted to mean "including, but not limited to." Further, the terms "axial" and "axially" generally mean along or substantially parallel to a central or longitudinal axis, while the terms "radial" and "radially" generally mean perpendicular to a central, longitudinal axis.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A cutting element, comprising:

a table coupled to a substrate at an interface, the table comprising:

a working surface opposite the interface and defined by a perimeter;

a torque transmittable depression formed in the working surface of the table;

a removable plug partially filling the torque transmittable depression; and a sensor disposed in a gap formed between the removable plug and the torque transmittable depression.

2. The cutting element of claim 1, a depth of the torque transmittable depression being greater than a table thickness measured between the interface and the working surface, such that the torque transmittable depression extends through the interface and into the substrate.

3. The cutting element of claim 1, the torque transmittable depression extending a depth into the table and having a cross-sectional profile with a torque transmittable shape that includes at least one curved side having varying radii of curvature.

4. The cutting element of claim 1, the torque transmittable depression extending a depth into the table and having a cross-sectional profile with a torque transmittable shape that includes at least two depressions a distance away from the perimeter.

5. The cutting element of claim 1, further comprising:

a through-hole extending between and communicating with a bottom surface of the depression and an outer surface of the substrate; and a wire extending from the sensor and at least partially through the through-hole.

6. A drill bit, comprising:

a bit body;

at least one cutter pocket formed in the bit body; and at least one cutting element of claim 1 in the at least one cutter pocket.

7. The bit of claim 6, the at least one cutting element being rotatably mounted to the at least one cutter pocket and configured to rotate while the drill bit is in use.

8. The bit of claim 6, the at least one cutting element being brazed into the at least one cutter pocket.

9. The bit of claim 6, the at least one cutting element further including a shaft extending from the substrate and in a direction opposite the table, the shaft being attached to the bit body and having a diameter less than a diameter of the substrate.

10. The bit of claim 9, the shaft being threadably secured to threads defined by the bit body.

11. A cutting element, comprising:

a substrate;

a table coupled to the substrate at an interface, a table thickness being measured between the interface and a working surface opposite the interface and defined by a perimeter; and at least one torque transmittable depression formed in the working surface of the table and extending a depth into the table, wherein the at least one torque transmittable depression has a cross-sectional profile that is constant along its depth.

12. The cutting element of claim 11, wherein the depth of the at least one torque transmittable depression is greater than the table thickness, such that the at least one torque transmittable depression extends through the interface and into the substrate.

13. The cutting element of claim 11, wherein the at least one torque transmittable depression includes multiple torque transmittable depressions formed around the perimeter of the working surface.

14. The cutting element of claim 13, wherein the multiple torque transmittable depressions are equally spaced around the perimeter of the working surface, and wherein circumferential cutting edges extend equal arc lengths between the multiple torque transmittable depressions.

15. The cutting element of claim 11 disposed in a cutter pocket formed on a bit body of a drill bit.

16. The cutting element of claim 11, wherein the at least one torque transmittable depression include multiple torque transmittable depressions interior to and spaced apart from the perimeter of the working surface and equally spaced from a central longitudinal axis of the cutting element.

17. A cutting element, comprising:

a substrate;

a table coupled to the substrate at an interface, a table thickness being measured between the interface and a working surface opposite the interface and defined by a perimeter; and at least one torque transmittable depression formed in the working surface of the table and extending a depth into the table;

wherein the at least one torque transmittable depression is interior to and a distance apart from the perimeter; and wherein a cutting edge formed around the perimeter has a constant curvature around the entire arc length of the perimeter.

18. The cutting element of claim 17, wherein the at least one torque transmittable depression includes multiple torque transmittable depressions equally spaced around a central longitudinal axis of the cutting element.

19. The cutting element of claim 17, wherein the at least one torque transmittable depression has a circular cross-sectional shape.

20. The cutting element of claim 17, wherein the at least one torque transmittable depression has a cross-sectional profile that is constant along its depth.

* * * * *